US005225642A

United States Patent [19]

Yamamoto et al.

[11] Patent Number: 5,225,642

[45] Date of Patent: Jul. 6, 1993

[54] DISCONNECTING SWITCH

[75] Inventors: Hiroshi Yamamoto; Tetsuo Mochizuki, both of Amagasaki, Japan

[73] Assignee: Mitsubishi Denki Kabushiki Kaisha, Tokyo, Japan

[21] Appl. No.: 568,174

[22] Filed: Aug. 16, 1990

[30] Foreign Application Priority Data

Aug. 24, 1989 [JP] Japan ..... 1-219637

[51] Int. Cl.[5] ..... H01H 9/42; H01H 33/16

[52] U.S. Cl. ..... 200/144 AP; 200/146 R

[58] Field of Search ..... 200/144 AP, 148 R, 148 B, 200/148 F, 145, 146 R, 148 A, 150 G; 361/11

[56] References Cited

U.S. PATENT DOCUMENTS 3,763,340 10/1973 Noack ..... 200/148 D
4,009,458 2/1977 Kishi et al. ..... 200/148 A
4,412,115 10/1983 Okumo ..... 200/148 A
4,488,021 12/1984 Yoshizumi ..... 200/144 AP

FOREIGN PATENT DOCUMENTS 868020 2/1953 Fed. Rep. of Germany .
1465375 6/1964 Fed. Rep. of Germany .
1939555 8/1969 Fed. Rep. of Germany .
58-165221 9/1983 Japan .
60-88440 6/1985 Japan .

*Primary Examiner*—Jeffrey A. Gaffin
*Assistant Examiner*—Michael A. Friedhofer
*Attorney, Agent, or Firm*—Burns, Doane, Swecker & Mathis

[57] ABSTRACT

In a disconnecting switch having a current-breaking duty, a stationary arc contact (18, 38) is held via a resistor (21, 41), and an end part of the stationary arc contact is arranged to engage with a hole (16c) formed in a movable contact (16) which is also to be connected with a stationary main contact (19) at an outer surface thereof.

6 Claims, 8 Drawing Sheets

DISCONNECTING SWITCH

FIELD OF THE INVENTION AND RELATED ART STATEMENT

1. Field of the Invention

The present invention relates to a disconnecting switch which is to be used in a power station or a substation to connect/disconnect a bus (or an electric line) with/from another bus (or another electric line) and more particularly relates to a disconnecting switch having a current-breaking duty.

2. Description of the Related Art

FIGS. 7(*a*), 7(*b*) and 7(*c*) are cross-sectional views each showing only a breaking part of a conventional disconnecting switch at three positions in a breaking process, respectively. Such disconnecting switch has been disclosed, for instance, in a gazette of Japanese unexamined published utility model application (Jikkai) Sho 60-88440. The breaking part consists of a stationary main contact 2, a stationary arc contact 3 and a movable contact 1. The stationary arc contact 3 is disposed with its left end part protruded beyond the stationary main contact 2 toward a disconnecting direction A of the movable contact 1. FIGS. 8(*a*), 8(*b*) and 8(*c*) are circuit diagrams which are equivalent circuits corresponding to the states of FIGS. 7(*a*), 7(*b*) and 7(*c*), respectively. By moving the movable contact 1 into and out of contact with the stationary main contact 2, the both contacts 1 and 2 constitute a switch 5, and also the movable contact 1 and the stationary arc contact 3 constitute a switch 6. A resistor 4 represents an intrinsic resistance of the stationary arc contact 3 which is made of a material having a comparatively high resistance.

Hereafter, a current-breaking operation of the above-mentioned disconnecting switch is described. FIG. 7(*a*) and FIG. 8(*a*) show a closed state of the disconnecting switch. That is, the movable contact 1 stably makes contact with the stationary main contact 2 and the arc contact 3. In this state, current $I_1$ flows through the switch 5 as shown in FIG. 8(*a*).

As shown in FIGS. 7(*b*) and 8(*b*), when the movable contact 1 is driven to thereby detach from the stationary main contact 2, the switch 5 is opened. In this state, since the movable contact 1 still makes contact with the stationary arc contact, the switch 6 keeps closed, thereby making a limited current $I_2$ ($I_2 < I_1$) which flows through the switch 6 and the resistor 4.

When the movable contact 1 moves further, as shown in FIGS. 7(*c*) and 8(*c*), the movable contact 1 detaches from the stationary arc contact 3, thus opening the switch 6. At that moment, an arc 7 is produced at the switch 6, nemely between the movable contact 1 and the stationary arc contact 3. Since an arc current $I_2'$ flows through the resistor 4, current-limiting action of the resistor 4 makes an effect on the arc 7, thereby expediting extinction of the arc 7. At an instance when the arc 7 is extinguished, current-breaking is completed.

In the above-mentioned disconnecting switch, the current-limiting action, which is derived from the intrinsic resistance of the arc contact 3, is utilized to improve current-breaking performance. A value of the resistance is determined by the applied material and sizes (such as thickness and length) of the arc contact 3. In practical use, since the value is very small such as roughly within a range of several hundred $\mu\Omega$ to 1000 $\mu\Omega$, the above-mentioned current-limiting construction is effective only in the relatively small current range.

In case the above-mentioned conventional disconnecting switch is intended to be used for breaking a large current such as 8000 A, it is necessary to improve the current-breaking performance by intensifying the current-limiting action. It is therefore necessary to increase the intrinsic resistance of the arc contact 3. One of methods for increasing the intrinsic resistance is to develop a new material having both excellent arc-resistant characteristic and the intrinsic resistance of several thousand times as large as that of copper. Another is to make the arc contact thin and long, thereby to increase the resistance. However, production of such new material is hopeless even in recent technology, and the thin and long arc contact will undesirably lower the mechanical reliability and will render a size of the disconnecting switch large.

OBJECT AND SUMMARY OF THE INVENTION

An object of the present invention is to provide a disconnecting switch having an excellent large-current-breaking performance through a strong current-limiting action without increasing its size.

In order to achieve the above-mentioned object, the disconnecting switch of the present invention comprises:

a stationary tank;

a first electrode which is fixedly mounted in the tank and is insulated therefrom;

a second electrode which is fixedly mounted in the tank and is insulated therefrom;

a movable contact which has a rod-shaped sliding part and is movably held in the second electrode in an axial direction of the sliding part, the movable contact having a hole at an end part of the sliding part;

a stationary main contact which is fixedly held in the first electrode and is electrically connected thereto, the stationary main contact being to make contact with an outer surface of the end part of the sliding part;

a resistor fixedly held in the first electrode, a first end of the resistor being electrically connected thereto; and a stationary arc contact, one end part of which is fixed and electrically connected to a second end of the resistor and the other end part of which is protruded beyond an end of the stationary main contact toward the movable contact, said other end part of the stationary arc contact being to make contact with an inner wall of the hole of the movable contact.

In the above-mentioned disconnecting switch, excellent current-limiting effect is obtained by a simple current-limiting construction without rendering its size large.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 2(*b*) is a side view of the stationary arc contact 18 seen from the right end in FIG. 2(*a*).

FIG. 4(*b*) is a vertical cross-sectional view showing only the breaking part of the disconnecting switch in a final stage of the breaking process.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereafter, preferred embodiments of the present invention are described with reference to the accompanying drawings.

Figure 1:
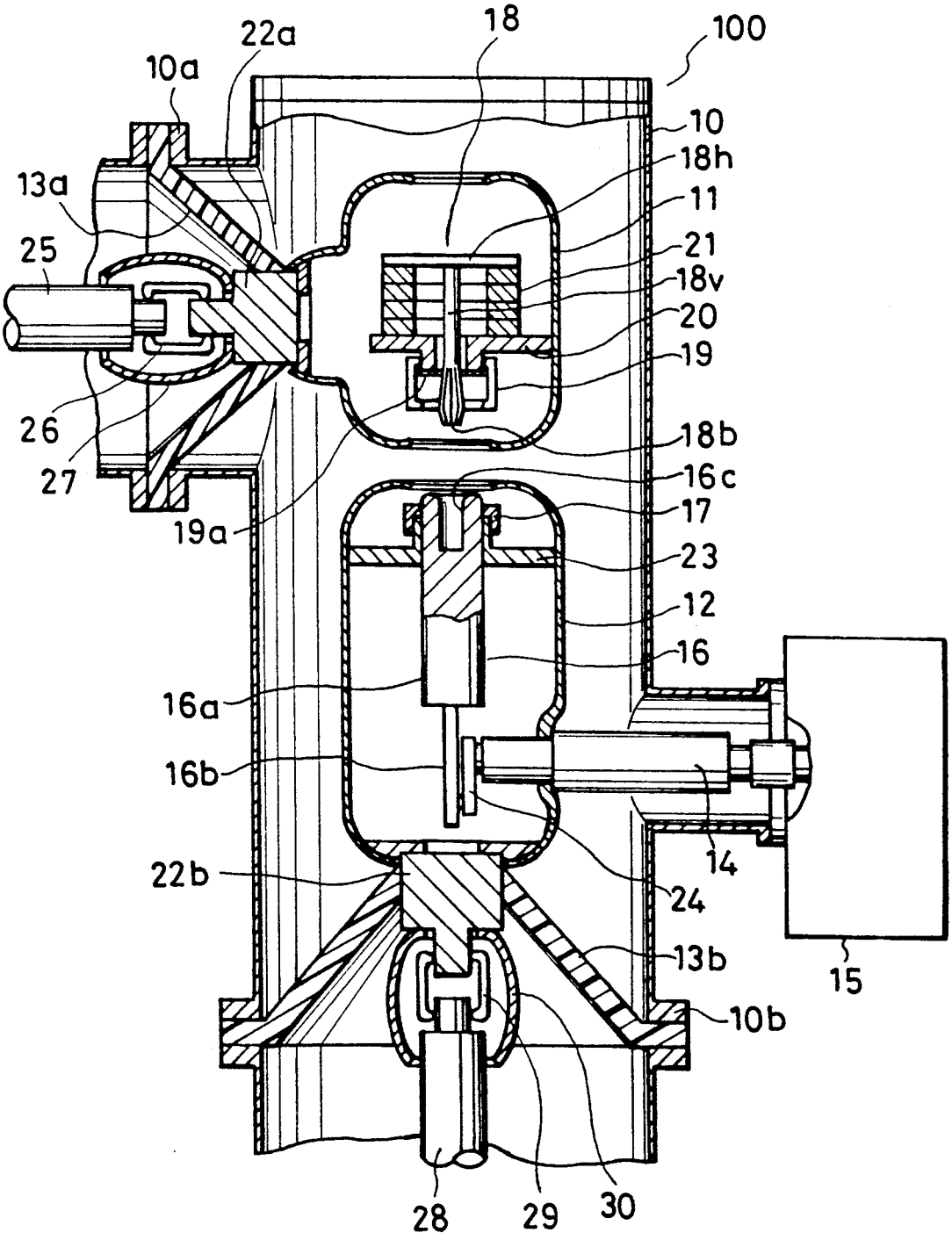
FIG. 1 is a vertical cross-sectional view showing a disconnecting switch 100 of the present invention in a completely disconnected state.

FIG. 1 is a vertical cross-sectional view showing a disconnecting switch 100 in a completely disconnected state. Peripheral portions of a pair of insulating spacers 13*a* and 13*b* are fixed to an upper flange 10*a* of a stationary tank 10 and a lower flange 10*b* of the tank 10, respectively. A terminal 22*a* of a first electrode 11 is fixed to the center of the insulating spacer 13*a*, and a terminal 22*b* of a second electrode 12 is fixed to the center of the insulating spacer 13*b*. Both the electrodes 11 and 12 are thus held and insulated from the tank 10. A bus 25 is connected to the terminal 22*a* via a connector 26, and this connecting part is covered with a shield member 27. Similarly, another bus 28 is connected to the terminal 22*b* via a connector 29, and this connecting part is covered with a shield member 30. In the electrode 11, a stationary main contact 19 and a stationary arc contact 18 are provided. The stationary main contact 19 is fixedly held by a supporting conductor 20, which is fixed to an inner wall of the electrode 11, via a guide sheet 19*a* of the stationary main contact 19. The stationary arc contact 18 is made of a substantially T-shaped conductor, and its vertical part 18*v* is of cylindrical-shape with plural slits 18*b* at a lower end part thereof. A pile of several doughnut-shaped resistor 21, which are principally made of carbon or the like heat resistive high resistivity material, is fixed on the supporting conductor 20, and a horizontal part 18*h* of the stationary arc contact 18 is fixed on the resistors 21. The stationary arc contact 18 and the stationary main contact 19 are disposed in coaxial alignment to each other in the vertical direction. In the second electrode 12, a supporting conductor 23 is fixed to the inner wall of the electrode 12. A movable contact 16 is slidably held by the supporting conductor 23 in the vertical direction. The supporting conductor 23 serves not only to slidably hold the movable contact 16 but also to make a good electrical connection between the electrode 12 and the movable contact 16. A sliding conductor 17, which is fixedly held by the supporting conductor 23, makes sliding contact with an upper end part of the movable contact 16. The movable contact 16 consists of a cylindrical part 16*a*, which is to make sliding contact with the supporting conductor 23 and the sliding conductor 17, and a plate-shaped part 16*b*. The cylindrical part 16*a* has a hole 16*c* in its upper center part to let the vertical part 18*v* of the stationary arc contact 18 therein. The plate-shaped part 16*b* is linked with a crank cam 24 which is to be driven by a driving mechanism 15 via an insulative operation rod 14. The insulativle operation rod 14 is disposed outside the second electrode 12 and serves to insulate both the movable contact 16 and the electrode 12, each having a high potential, from the driving mechanism 15 of a grounded potential. The insulative operation rod 14 is rotated by the driving mechanism 15, and its rotating motion is converted to linear motion of the movable contact 16 via the crank cam 24.

Figure 2:
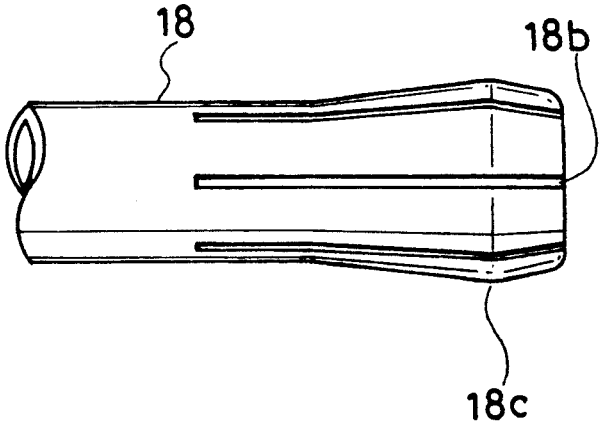
FIG. 2(*a*) is a front view showing an end part of the stationary arc contact 18 in FIG. 1.
Figure 2:
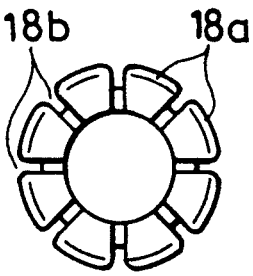

FIG. 2(*a*) is a front view showing an end part of the stationary arc contact 18, and FIG. 2(*b*) is a side view of the stationary arc contact 18 seen from the right end in FIG. 2(*a*). In an end part of the stationary arc contact 18, plural slits 18*b* are formed, thereby making plural (e.g. 8 pieces) separate strips 18*a* each having elasticity in the radial direction of the stationary arc contact 18. Each of the strips 18*a* has a swelling part 18*c*, which forms an outer circumference of slightly larger diameter than that of an inner wall of the hole 16*c* (FIG. 1). When the hole 16*c* of the movable contact 16 is engaged with the stationary arc contact 18, each of the strips 18*a* makes contact with the inner wall of the hole 16*c* with a proper contacting pressure by its elasticity.

Figure 3:
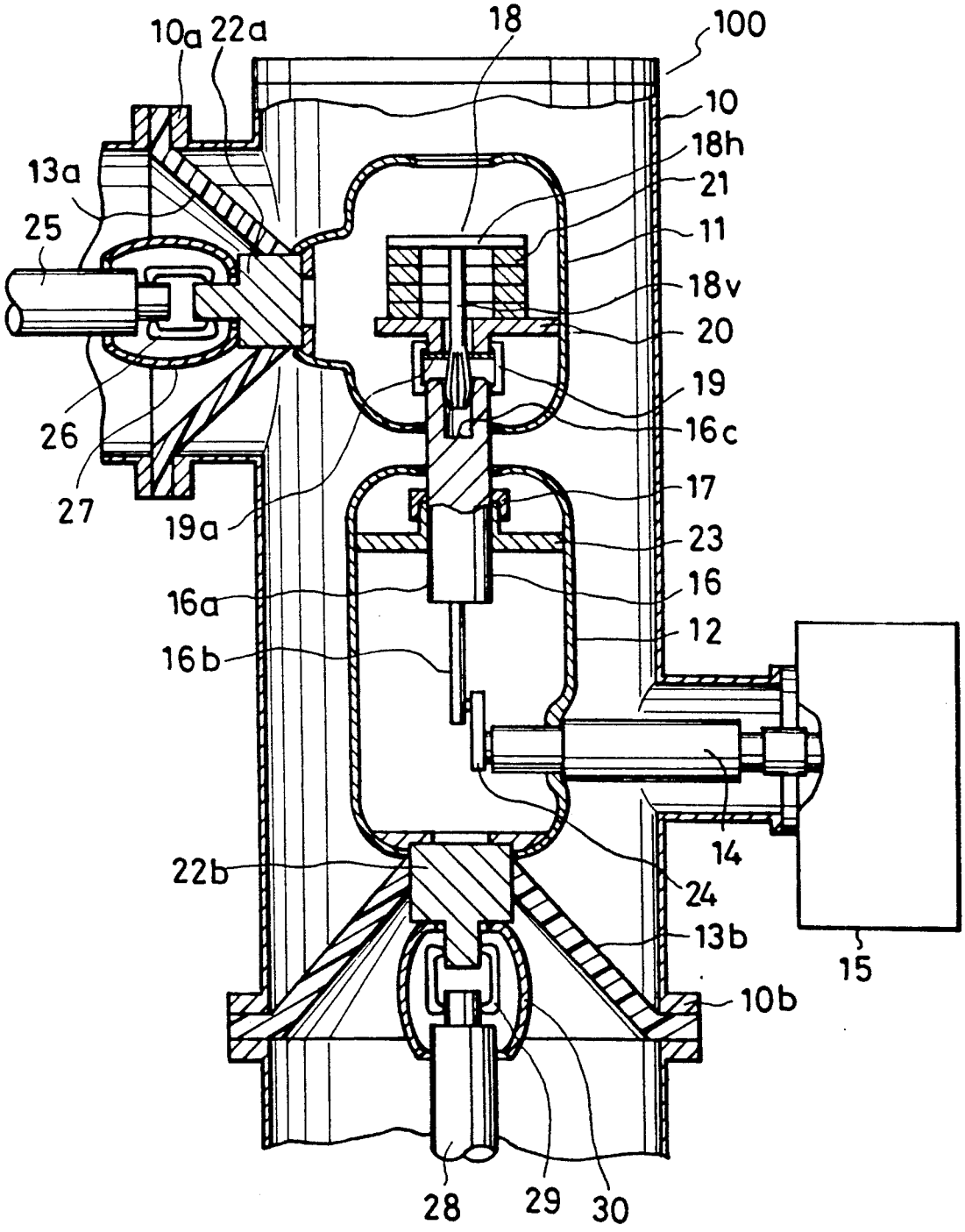
FIG. 3 is a vertical cross-sectional view showing the disconnecting switch 100 in a closed state.

Next, operation of the above-mentioned disconnecting switch is described. FIG. 3 is a vertical cross-sectional view showing the disconnecting switch in a closed state. In this state, an outer surface of the movable contact 16 stably makes contact with the stationary main contact 19, and the inner wall of the hole 16*c* stably makes contact with the stationary arc contact 18. Current flows mainly through the stationary main contact 19.

Figure 4A:
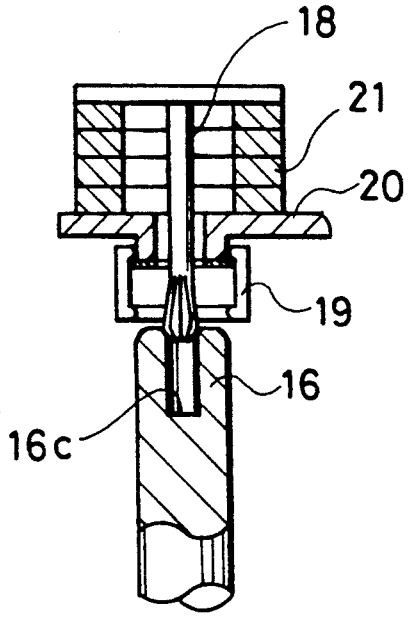
FIG. 4(*a*) is a vertical cross-sectional view showing only a breaking part of the disconnecting switch in an early stage of the breaking process.
Figure 4B:
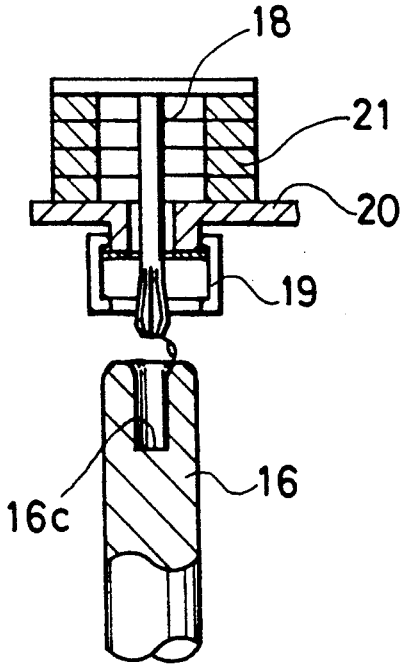

FIG. 4(*a*) is a vertical cross-sectional view showing only the breaking part of the disconnecting switch in an early stage of the breaking process, and FIG. 4(*b*) is a vertical cross-sectional view showing the same but in a final stage of the breaking process. When the movable contact 16 moves downward as shown in FIG. 4(*a*), the movable contact 16 is disconnected from the stationary main contact 19. However, since a top end wall part of the hole 16*c* in the movable contact 16 is still in contact with the stationary arc contact 18, current flows from the stationary arc contact 18 to the first electrode 11 (FIGS. 1 or 3) through the resistors 21 and the supporting conductor 20. This current is sufficiently limited by the current limiting action of the resistors 21. When the movable contact 16 moves downward further as shown in FIG. 4(*b*), the movable contact 16 is detached from the stationary arc contact 18, and the current limited by the resistors 21 is interrupted. Positional relations among the three contacts 16, 18 and 19 is selected so that the disconnection of the movable contact 16 from the stationary arc contact 18 takes place with a delay time of at least half cycle period of the power source frequency from the instance of disconnection of the movable contact 16 from the stationary main contact 19.

Figure 5:
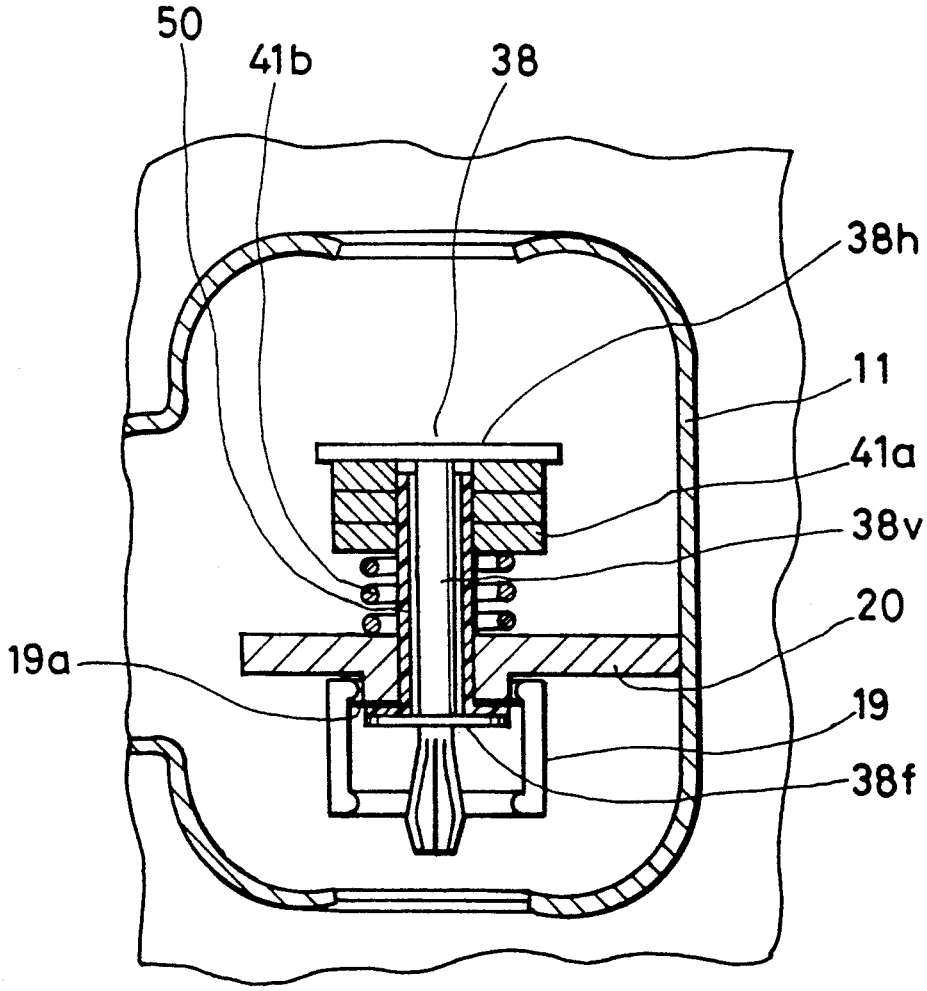
FIG. 5 is a vertical cross-sectional view showing a first electrode 11 of another embodiment of the present invention.

FIG. 5 is a vertical cross-sectional view showing only a first electrode 11 of another embodiment of the disconnecting switch. Since other parts of the disconnecting switch are the same as those in the first embodiment, illustration of them is omitted and the description thereon made in the first embodiment similarly applies. Differences and features of this second embodiment from the first embodiment are as follows.

A stationary arc contact 38 of this embodiment has a similar configuration to that of the first embodiment except that a flange member 38*f* is provided in addition. The flange member 38*f* is fixed to the supporting conductor 20 by screws etc. (not shown) via an insulating spacer 50. The whole stationary arc contact 38 is thereby held by the supporting conductor 20 tightly and is insulated therefrom. The insulating spacer 50 is of cylindrical shape with a flange member at one end thereof and is inserted into the supporting conductor 20. The vertical part 38*v* of the stationary arc contect 38 is covered with the insulating spacer 50. A pile of several (e.g. three) doughnut-shaped resistors 41*a*, which are made of carbon or the like high resistivity material, are held around the insulating spacer 50. A compression spring 41*b*, which is held around the insulating spacer 50, urges the resistors 41*a* to pushingly make contact with the horizontal part 38*h* of the stationary arc contact 38. This spring 41*b* also serves to make electrical connection between the resistors 41*a* and the supporting conductor 20.

Disconnecting operation is quite similar to that of the first embodiment which has been shown in FIGS. 4(*a*) and 4(*b*).

Figure 6:
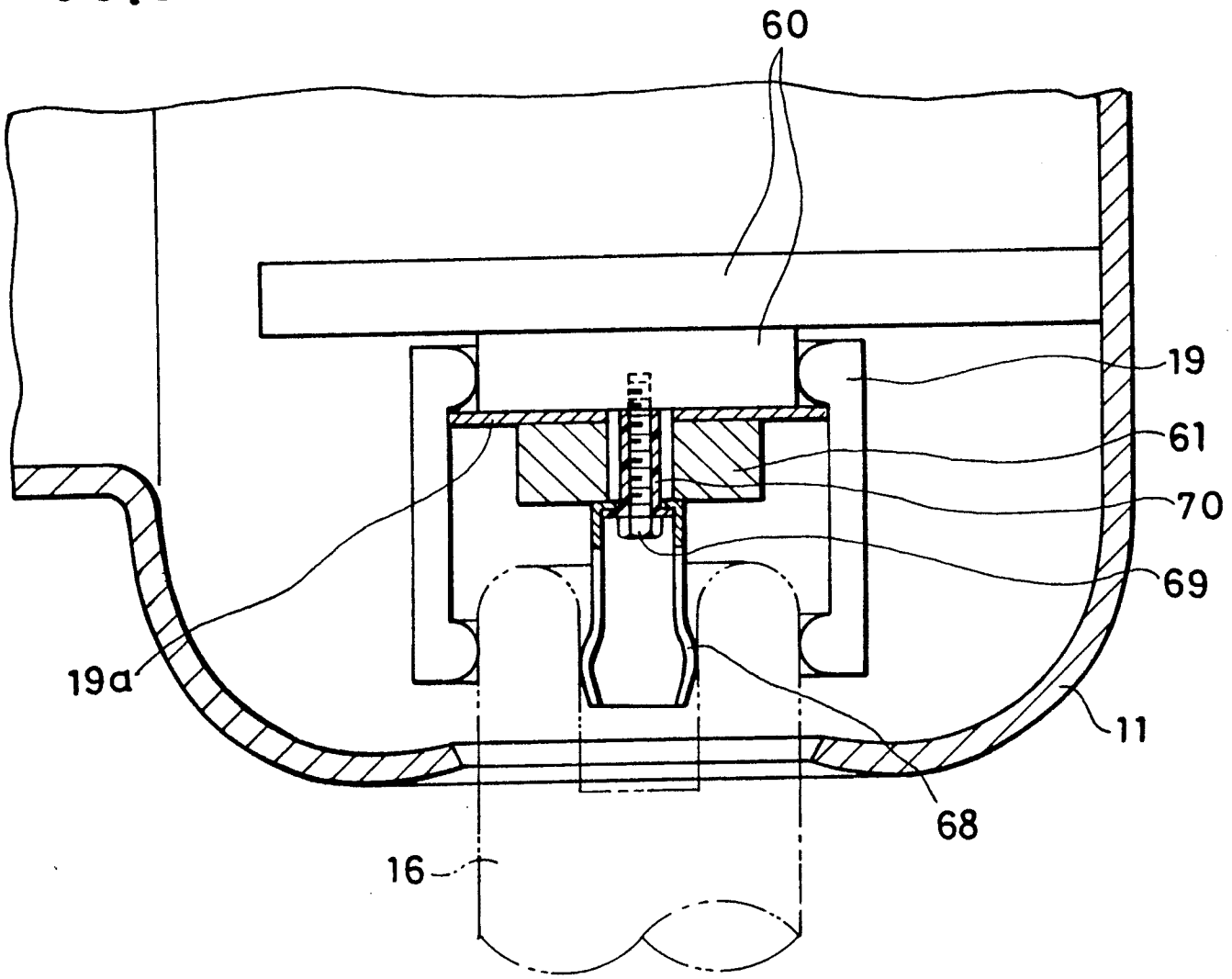
FIG. 6 is a vertical cross-sectional view showing a first electrode 11 of a still other embodiment of the present invention.
Figure 7A:
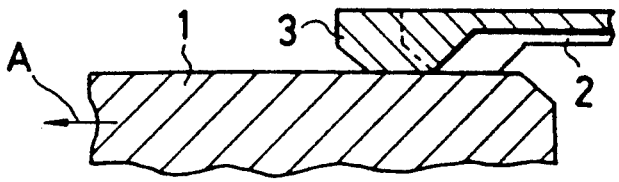
FIG. 7(a) (Prior Art)
FIGS. 7(*a*), 7(*b*) and 7(*c*) are cross-sectional views each showing only a breaking part of a conventional disconnecting switch at three positions in breaking process, respectively.
Figure 7B:
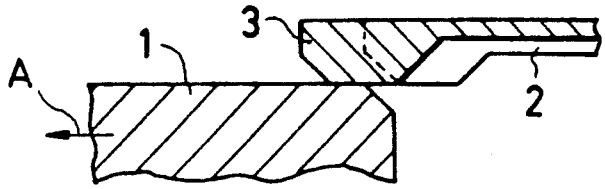
FIG. 7(b) (Prior Art)
Figure 7C:
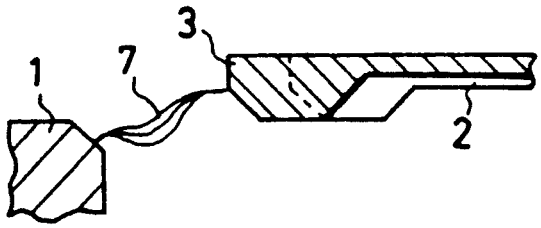
FIG. 7(c) (Prior Art)
Figure 8A:
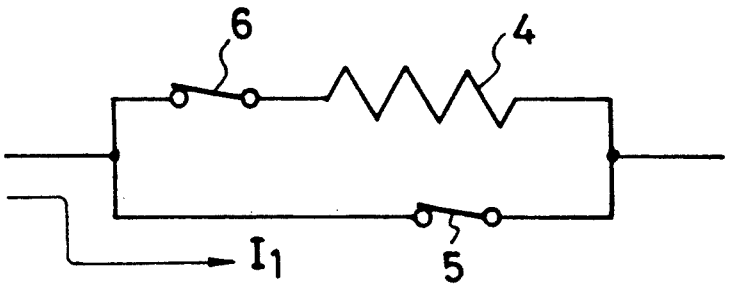
FIG. 8(a) (Prior Art)
FIGS. 8(*a*), 8(*b*) and 8(*c*) are circuit diagrams which are equivalent circuits corresponding to the states of FIGS. 7(*a*), 7(*b*) and 7(*c*), respectively.
Figure 8B:
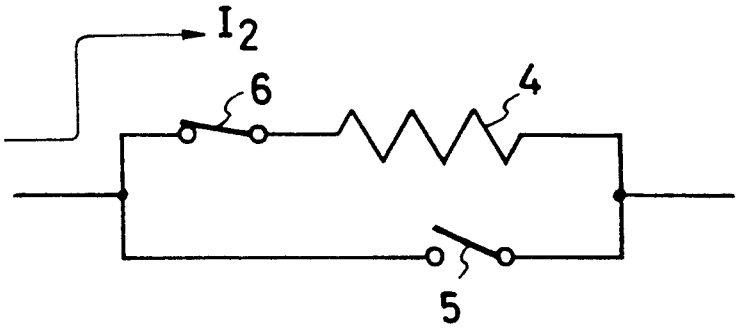
FIG. 8(b) (Prior Art)
Figure 8C:
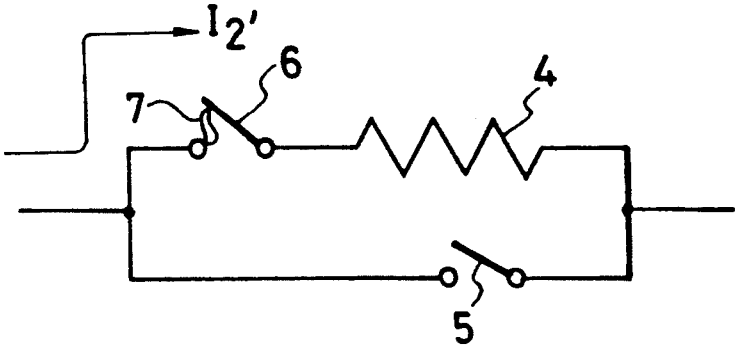
FIG. 8(c) (Prior Art)

FIG. 6 is a vertical cross-sectional view showing only a first electrode 11 of a still other embodiment of the disconnecting switch. Since other parts of the disconnecting switch are the same as those in the first embodiment, illustration of them is omitted and the description thereon made in the first embodiment similarly applies. Differences and features of this third embodiment from the first embodiment are as follows.

In FIG. 6, a supporting conductor 60 is fixed to an inner wall of the first electrode 11. A short columnar resistor 61 is fixed to the supporting conductor 60 together with the guide sheet 19*a* of the stationary main contact 19, and a stationary arc contact 68 is fixed to the resistor 61 by a bolt 69 with an insulating sleeve 70. A stationary main contact 19, which is fixedly held by the supporting conductor 60, is disposed to surround the resistor 61 and the stationary arc contact 68. The stationary main contact 19, the stationary arc contact 68 and the resistor 61 are arranged in a coaxial alignment in the vertical direction. There are two routes for flowing current from the movable contact 16 to the electrode 11 when the movable contact 16 is engaged as shown in FIG. 6. One is the route through the stationary main contact 19 and the supporting conductor 60, and the other is the route through the stationary arc contact 68, the resistor 61 and the supporting conductor 60.

Disconnecting operation is quite similar to that of the first embodiment which has been shown in FIGS. 4(*a*) and 4(*b*).

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A disconnecting switch, comprising:

a stationary tank;

a first electrode which is fixedly mounted in said tank and is insulated therefrom;

a second electrode which is fixedly mounted in said tank and is insulated therefrom;

a movable contact which has a rod-shaped sliding part and is movably held in said second electrode in an axial direction of said sliding part, said movable contact having a hole at an end part of said sliding part;

a stationary main contact which is fixedly held in said first electrode and is electrically connected thereto, said stationary main contact being arranged to make contact with an outer surface of said end part of the sliding part;

a resistor fixedly held in said first electrode, a first end of said resistor being electrically connected thereto, said resistor being made of a plurality of doughnut-shaped resistor elements which are stacked with so that holes of said doughnut-shaped resistor elements are aligned in said axial direction; and a stationary arc contact disposed in coaxial alignment with said resistor, one end part of which is fixed and electrically connected to a second end of said resistor and another end part of which protrudes beyond an end of said stationary main contact toward said movable contact, said other end part of the stationary arc contact being arranged to make contact with an inner wall of said hole of the movable contact.

2. A disconnecting switch as claimed in claim 1, wherein said other end part of the stationary arc contact is substantially cylindrical and has a plurality of slits.

3. A disconnecting switch as claimed in claim 1, further comprising means for compressing said doughnut-shaped resistor elements against said one end part of said stationary arc contact.

4. A disconnecting switch as claimed in claim 3, wherein said compressing means includes a compression spring.

5. A disconnecting switch, comprising:

a stationary tank;

a first electrode which is fixedly mounted in said tank and is insulated therefrom;

a second electrode which is fixedly mounted in said tank and is insulated therefrom;

a movable contact which has a rod-shaped sliding part and is movably held in said second electrode in an axial direction of said sliding part, said movable contact having a hole at an end part of said sliding part;

a stationary main contact which is fixedly held in said first electrode and is electrically connected thereto, said stationary main contact for making contact with an outer surface of said end part of the sliding part;

a short columnar resistor fixedly held in said first electrode, a first end of said resistor being electrically connected thereto, said resistor being arranged within an inner space of said stationary main contact; and a stationary arc contact, one end part of which is fixed and electrically connected to a second end of said resistor and the other end part of which protudes beyond an end of said stationary main contact toward said movable contact, said other end part of the stationary arc contact for making contact with an inner wall of said hole in the movable contact.

6. A disconnecting switch as claimed in claim 5, wherein said stationary arc contact is bolted to said first electrode through said resistor.

* * * * *